US007070445B2

(12) United States Patent
Shah et al.

(10) Patent No.: US 7,070,445 B2
(45) Date of Patent: Jul. 4, 2006

(54) CABLE ASSEMBLY

(75) Inventors: Arun Shah, Bartlett, IL (US); Anil Bali, Glen Ellyn, IL (US)

(73) Assignee: Cinch Connectors, Inc., Lombard, IL (US)

( * ) Notice: Subject to any disclaimer, the term of this patent is extended or adjusted under 35 U.S.C. 154(b) by 206 days.

(21) Appl. No.: 10/439,477

(22) Filed: May 15, 2003

(65) Prior Publication Data

US 2004/0229497 A1 Nov. 18, 2004

(51) Int. Cl.
*H01R 12/24* (2006.01)

(52) U.S. Cl. ..... 439/498; 439/397

(58) Field of Classification Search ..... 439/498, 439/397, 505, 638, 639, 502, 623, 362; 174/59, 174/52.4

See application file for complete search history.

(56) References Cited

U.S. PATENT DOCUMENTS 2,593,743 A * 4/1952 Galvao ..... 439/418
3,189,863 A * 6/1965 Leach ..... 439/418
3,336,434 A * 8/1967 Crimmins ..... 174/72 R
3,705,378 A * 12/1972 Elkins ..... 439/638
3,727,168 A * 4/1973 Henschen et al. ..... 439/498
3,963,300 A * 6/1976 Patton et al. ..... 439/638
4,034,470 A * 7/1977 Patton et al. ..... 29/866
4,075,758 A * 2/1978 Parsons et al. ..... 29/866
4,227,763 A * 10/1980 Marks ..... 439/404
4,236,779 A * 12/1980 Tang ..... 439/610
4,592,614 A * 6/1986 Myers, Jr. ..... 439/404
4,767,353 A * 8/1988 Hughes et al. ..... 439/398
4,902,236 A * 2/1990 Hasircoglu ..... 439/77
4,913,660 A * 4/1990 Hirai ..... 439/395
4,988,890 A * 1/1991 Narhi et al. ..... 307/147
5,041,009 A * 8/1991 McCleerey ..... 439/405
5,044,964 A * 9/1991 Minerd et al. ..... 439/67
5,192,226 A * 3/1993 Wang ..... 439/502
5,234,360 A * 8/1993 Kramer, Jr. ..... 439/505
5,387,110 A * 2/1995 Kantner et al. ..... 439/59
5,397,248 A * 3/1995 Whiteman et al. ..... 439/571
5,421,741 A * 6/1995 David et al. ..... 439/405
5,433,625 A * 7/1995 Tsuji et al. ..... 439/397
5,468,159 A * 11/1995 Brodsky et al. ..... 439/501
5,741,155 A * 4/1998 Herman ..... 439/502
5,834,693 A * 11/1998 Waddell et al. ..... 174/65 R
5,902,148 A * 5/1999 O'Rourke ..... 439/505
6,171,139 B1 * 1/2001 Sato et al. ..... 439/502
6,231,379 B1 * 5/2001 Shen ..... 439/505
6,666,708 B1 * 12/2003 Saito ..... 439/466

OTHER PUBLICATIONS

Photographs of cable assembly by unknown entity, available to applicant in approximately Oct., 2002.

* cited by examiner

*Primary Examiner*—Tho D. Ta
*Assistant Examiner*—Larisa Tsukerman
(74) *Attorney, Agent, or Firm*—Leydig, Voit & Mayer, Ltd.

(57) ABSTRACT

Provided is a communications cable assembly and method of making the same. The cable includes a plurality of conductive wires coated with an insulative jacket and bound within a cover. Located at a first end of the cable is a first connector that includes a plurality of insulation displacement contacts that can receive the wires. Located along the cable between the first and second ends is a second connector that includes a plurality of insulation displacement contacts. The wires are received in the insulation displacement contacts of the second connector prior to being received by the insulation displacement contacts of the first connector. The first connector and second connector are thereby connected in series. A third connector including a third plurality of insulation displacement contacts can be located at the second end of the cable. In an embodiment, the first and second connectors can be rigidly bound to each other.

31 Claims, 16 Drawing Sheets

CABLE ASSEMBLY

FIELD OF THE INVENTION

This invention relates generally to cables and, more particularly, to communications cable assemblies for connecting electronic and testing equipment.

BACKGROUND OF THE INVENTION

To provide communication between remotely located pieces of electronic equipment, flexible cables extend between communication ports located on the equipment. The cables are made of a plurality of conductive wires bundled together within a cover wherein each wire is capable of carrying a transmitted electrical signal. Thus the cable establishes a plurality of electrical communication paths between the equipment. To prevent cross talk or short-circuiting of the wires, each wire includes an insulation jacket made of a non-conductive material that surrounds a conductive core of the wire.

To facilitate connection of the cable to the equipment, connectors are typically assembled at the ends of the cable. The connectors include contacts for establishing isolated communication between each wire and a corresponding receptacle within the communication port. In order to disconnect a cable from a particular piece of equipment, the connectors are often configured to releasably connect with the communication ports.

Often, it is desirable to connect more than two remotely located pieces of electronic equipment together to establish a multi-piece network. Furthermore, it is often necessary to temporally connect a piece of testing equipment to the network to perform diagnostics or otherwise monitor the network. After performing the diagnostics or monitoring, the testing equipment is then disconnected from the network. However, electronic and testing equipment often have a limited number of communications ports and it is therefore necessary to develop appropriate cabling and splicing schemes.

SUMMARY OF THE INVENTION

The present invention provides a communication cable assembly and a method for making the same for establishing communication between multiple pieces of electronic equipment. The cable assembly includes a cable and at least two connectors configured to releasably connect to communication ports located on the electronic equipment. Each connector includes an insulative housing that supports a plurality of insulation displacement contacts ("IDC's"). The IDC has a retainer segment configured to receive a length of the wire from the cable in such a manner that some of the insulation surrounding the wire is cut away and electrical contact is made with the conductive core of the wire. The IDC further has a terminal segment that establishes the electrical connection with contacts in the communications ports on the electronic equipment.

One connector is provided at a first end of the cable with the wires from the end of the cable inserted into the IDCs. An additional connector is also provided along the length of the cable where wires from the cable are removed from the cover and inserted into the IDCs of the additional connector. A third connector, which may be the same as or different from the first two connectors, can be provided at the second end of the cable. Thus, the communications cable assembly provides multiple connectors that are connected in series with one another.

In an embodiment of the communications cable assembly, the connector located along the length of the cable is in close proximity to a connector located at the first end of the cable. The housings of the two connectors can be rigidly bound to each other so that the connectors are in a back-to-back relationship. In another embodiment, the two connectors can be substantially spaced apart to provide a span or length of cable for accessing remotely located equipment.

Thus an advantage of the present invention is that it provides a communications cable assembly including multiple releasable connectors that can connect with multiple pieces of electronic equipment or testing equipment. Because the connectors are in series and configured to be releasable, the electronic or testing equipment can be easily switched in and out of the network without shutting down the other equipment. Because of the use of the IDCs within the connectors, the cable assembly can be manufactured from readily available cable having a plurality of wires. Another advantage of using IDCs is that the length of the cable assembly between the first connector and the second connector can be easily adjusted when the cable is being produced. These and other advantages and features of the present invention will be apparent from the detailed description and accompanying drawings.

DETAILED DESCRIPTION OF THE DRAWINGS

Figure 1:
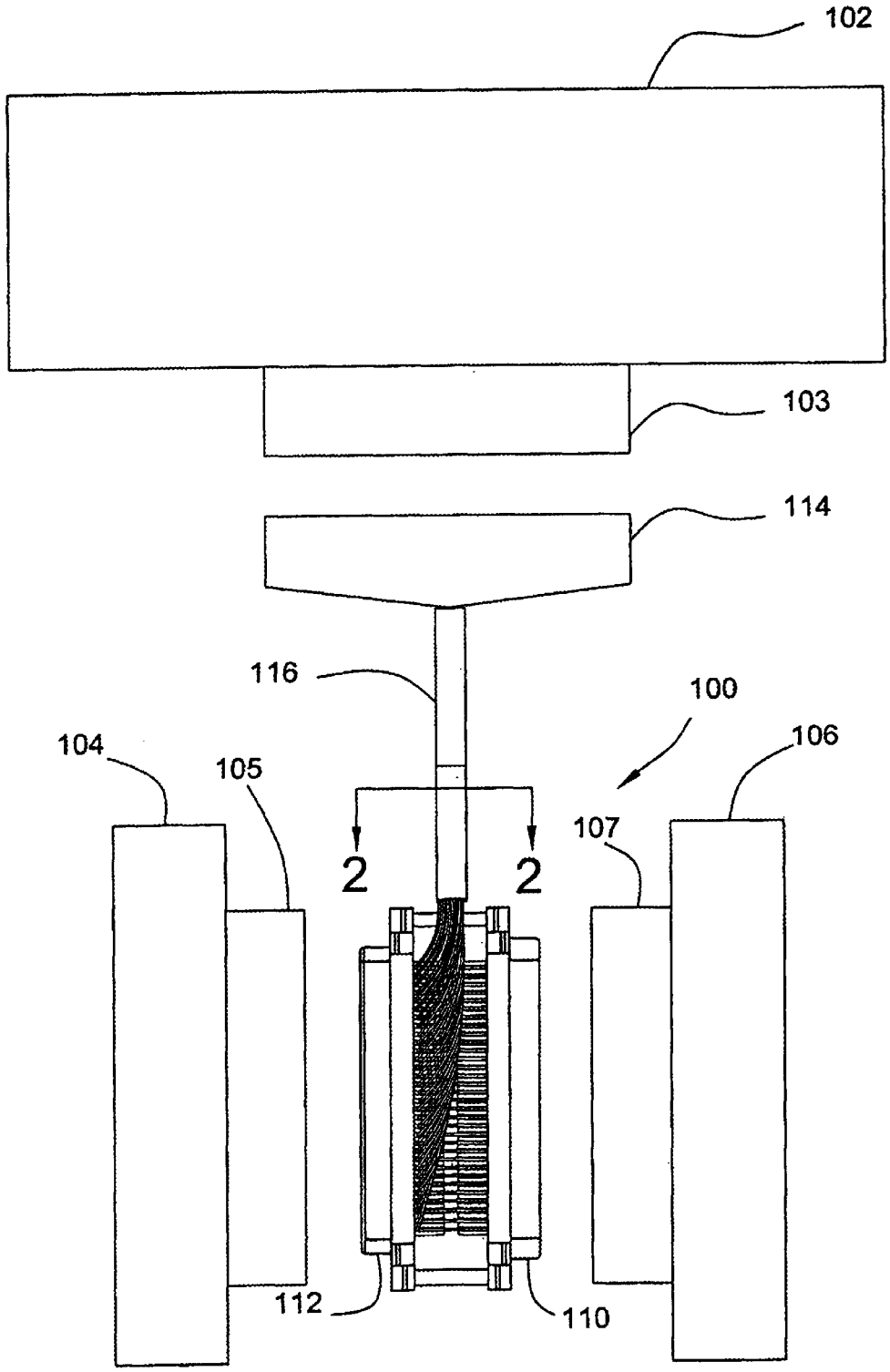
FIG. 1 is a top plan view of an embodiment of a communications cable assembly having features in accordance with the present invention situated in an exemplary network setting.

Now referring to the drawings, wherein like reference numbers refer to like elements, there is illustrated in FIG. 1 an embodiment of a communications cable assembly 100 situated among an illustrative network of electronic and/or testing equipment. The network may include central office equipment 102, a telecommunications switch 104, and a piece of testing equipment 106. Each piece of network equipment 102, 104, and 106 includes a respective communications port 103, 105 and 107. To connect to and establish communication among the network equipment, the communications cable assembly 100 includes a first connector 110, a proximately located second connector 112, and a third connector 114 all connected in series to a flexible cable 116.

Figure 2:
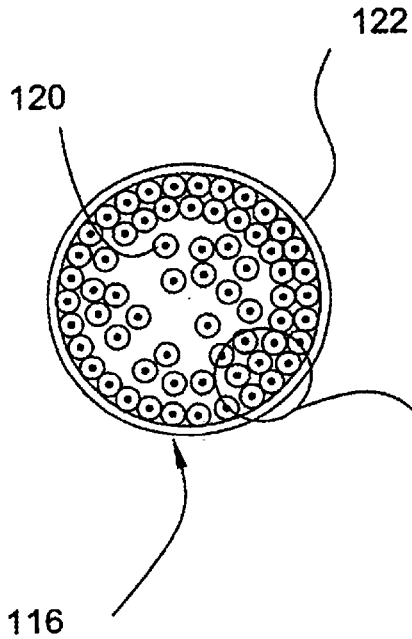
FIG. 2 is a cross sectional view of the cable taken along line 2—2 of FIG. 1.
Figure 3:
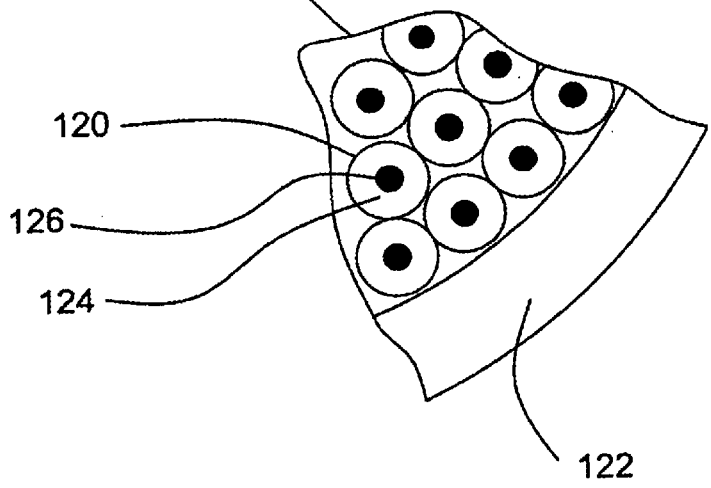
FIG. 3 is a detailed view of the wires of the cable taken of the indicated section of FIG. 2.

Referring to FIG. 2, the cable 116 is made of a plurality of elongated, conductive wires 120 aligned together and enclosed in a flexible cover 122. A known advantage of multiple conductor cables is that such cables provide a plurality of electrical communication paths in an organized fashion that eliminates the untidiness associated with running individual wires to connect equipment. In addition to the flexible cover, tie wraps of varying styles can be used for organizing the plurality of wires. To prevent cross talk and short-circuiting between the wires 120 within the cable 116, as illustrated in FIG. 3, each wire includes an insulative jacket 124 that encases a conductive core 126. The core 126 can be made of drawn copper or a similar flexible, conductive material and may be plated with additional, conductive material. The insulative jacket 124 can typically be made of plastic. To assist in correctly connecting the individual wires to the connectors, the insulative jackets of each wire can be color-coded and numerically labeled for identification purposes.

Suitable cable for producing the communications cable assembly is readily available from Lucent Technologies under the part number 105 412 498. In the illustrated embodiment, the particular cable includes 64 wires of 26 gauge (AWG) bound in a cover of 0.020 inch thick plastic insulation, though different numbers of wires, different gauge sizes, and different covers may be used to produce the communications cable assembly.

Figure 4:
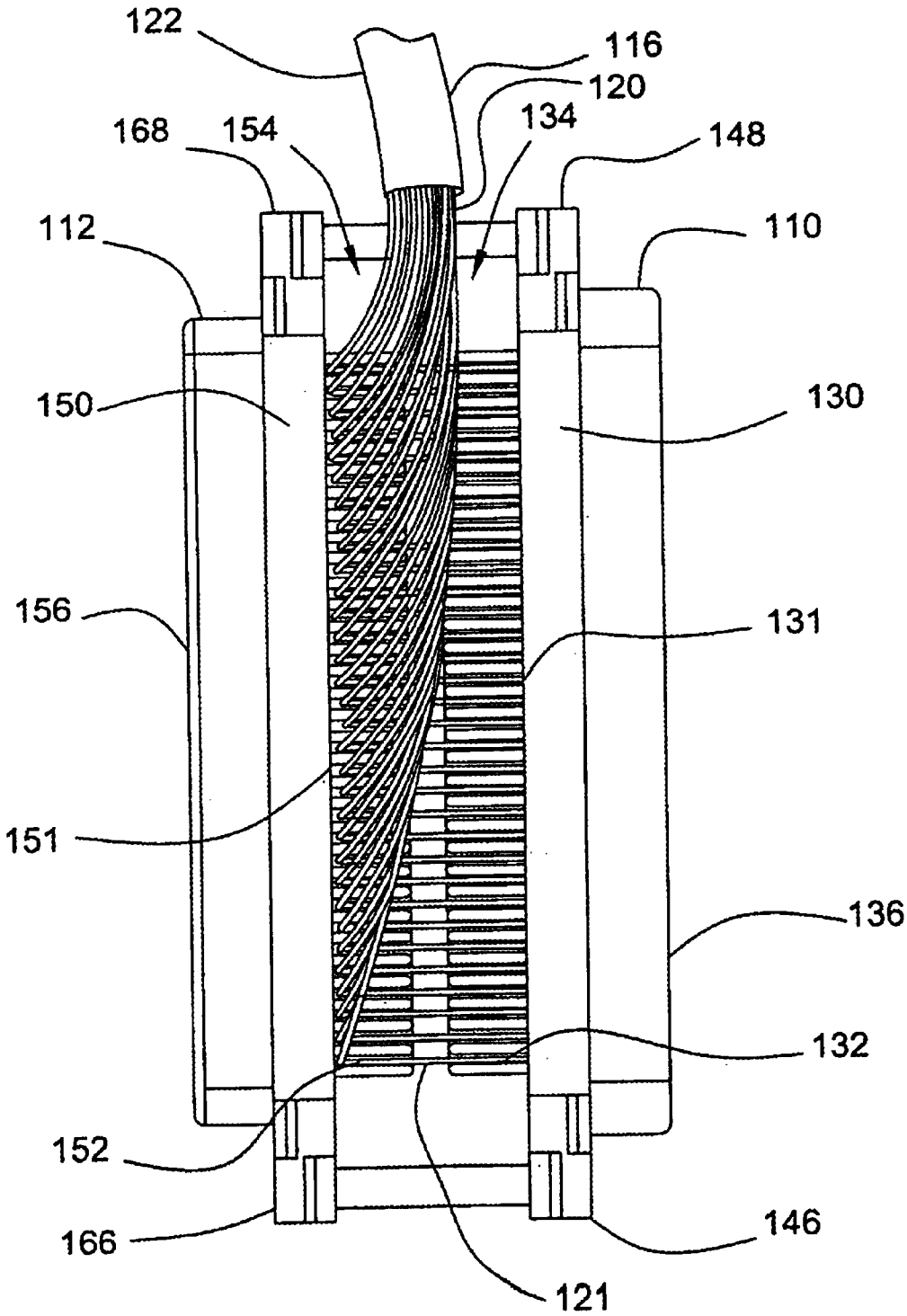
FIG. 4 is a top plan view of the communications cable assembly of FIG. 1 illustrating the cable, wires, first connector, and second connector.

Better illustrated in FIG. 4 is the arrangement between the first connector 110, the second connector 112, and the cable 116. The cover 122 has been removed from the end of the cable 116 to expose the plurality of wires 120 which are directed between the opposing first and second connectors 110, 112. Each connector includes a first and second housing 130, 150, respectively, that has a first and second plurality of slots 132, 152, respectively. The slots 132, 152 extend from a receiving side 131, 151 of the first and second housings 130, 150. The housings 130, 150 can be made of an insulative material such as plastic. Each of the wires 120 enters one of the second plurality of slots 152 associated with the second connector 112 then extends across and enters one of the first plurality of slots 132 associated with the first connector 110.

Located within each slot of the housings is an insulation displacement contact ("IDC") in which the wire can be inserted and retained. Various types of IDCs are known in the art. IDCs function by removing from the wire a portion of the insulative jacket to expose and contact the conductive core during insertion of the wire. Exemplary IDC's 170, such as the one illustrated in FIGS. 5, 6, and 7, are manufactured by Cinch Connectors of Lombard, Ill. under the part numbers 416 00 15 371-628 and 416 00 15 370-628.

Figure 5:
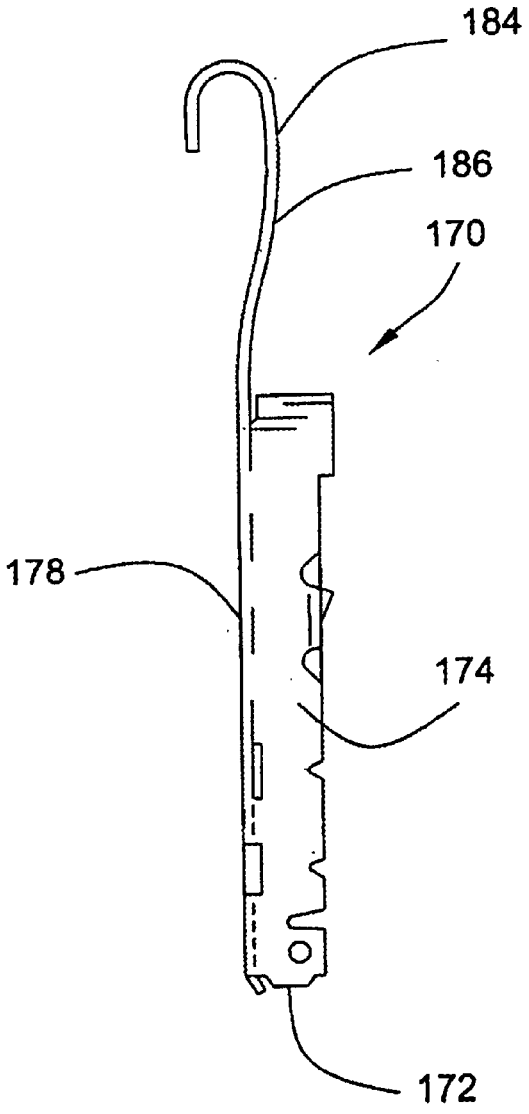
FIG. 5 is a side elevational view of an exemplary insulation displacement contact ("IDC") contained within the connectors of the communications cable assembly.
Figure 6:
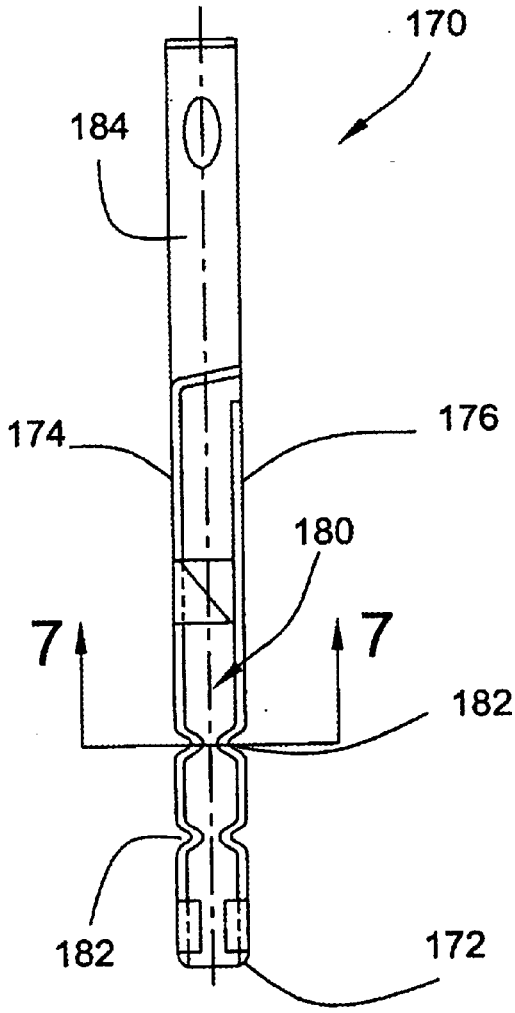
FIG. 6 is a top plan view of the IDC.
Figure 7:
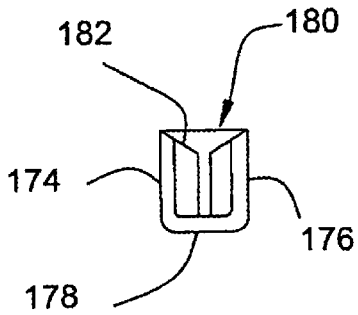
FIG. 7 is a front view of the IDC taken along lines 7—7 of FIG. 6.
Figure 8:
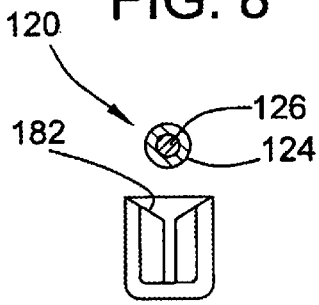
FIG. 8 is a front view of the IDC and a wire illustrating the wire being inserted into the IDC.
Figure 9:
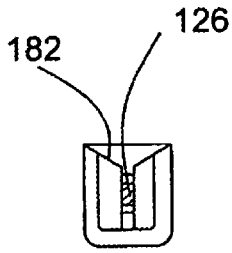
FIG. 9 is a front view of the IDC and the wire after insertion of the wire into the IDC.

The exemplary IDC 170 illustrated in FIGS. 5, 6, and 7 includes a retainer segment 172 that is defined by two opposing walls 174, 176 extending from a spine 178 that thereby defines a longitudinal channel 180. The width of the channel 180 is preferably commensurate with the diameter of the wire to be inserted into the IDC 170. Extending into the channel 180 from the opposing walls 174, 176 are two pairs of cutters 182. As illustrated in FIGS. 8 and 9, upon insertion of the wire 120 into the channel 180, the cutters 182 remove the insulative jacket 124 from the wire thereby exposing and contacting the conductive core 126. To retain the wire 120 within the IDC, as illustrated in FIG. 9, the conductive core 126 is securely gripped between the cutters 182. A tool can be used to facilitate the insertion.

Referring to FIGS. 5 and 6, the spine 178 of the IDC 170 extends axially from the retainer segment 172 in a hook-like shape to form a terminal segment 184 for making electrical contact with the communications port on the pieces of electrical equipment. To facilitate the electrical contact, there is a slight upwards bend 186 to the spine 178 that, along with the hook-like shape, provides the terminal segment 184 with a resilient quality. The IDC can be made from a conductive metal formed by bending or stamping a metal sheet.

Figure 13:
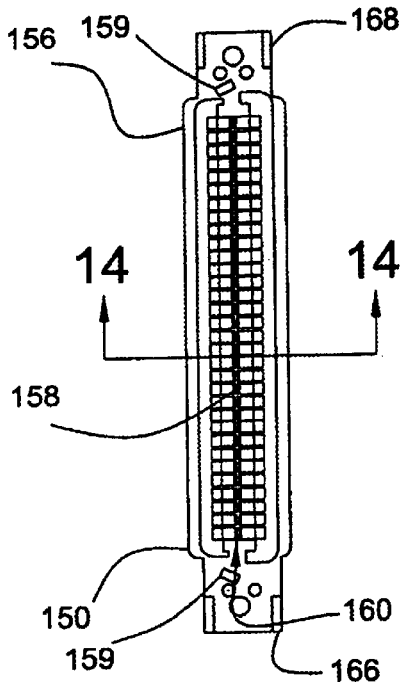
FIG. 13 is a front elevational view of the mating side of the second connector.
Figure 11:
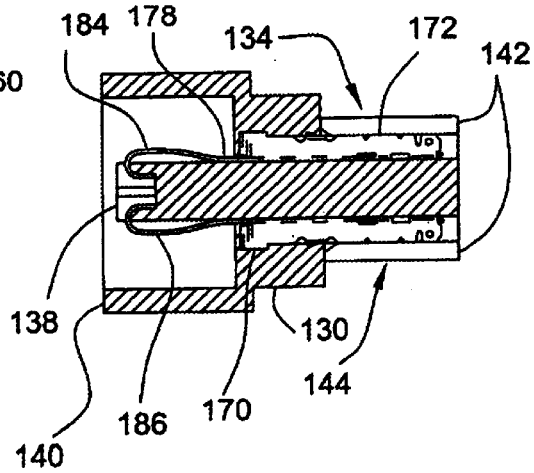
FIG. 11 is a cross sectional view of the first connector taken along line 11—11 of FIG. 10.

Referring to FIG. 4, the slots 132, 152 of the first and second connectors 110, 112 are arranged parallel with each other in opposing rows 134, 154. Referring to FIGS. 11 and 13, the retaining segments 172 of the IDCs are located within the slots 132, 152 so that the channel is directed toward the opening of the slot. Referring back to FIG. 4, each wire 120 extending from the cable 116 is first inserted into a slot 152 of the second connector proximate to where the slot extends from the second housing 150. The wire 120 is thereby inserted into the retaining segment of an IDC located therein in the above-described manner. An end portion 121 of the wire then extends from the slot 152 across to the first connector 110 where it is received in a slot 132 and likewise inserted into a retaining segment of an IDC. Electrical communication is thereby established in series between the first and second connectors. For example, the distance between the first and second connectors 110, 112 across which the wire must extend can be between 0.08 inches and 1 foot. However, the precise distance between the first and second connectors is unimportant so long as the wires enter slots on the second connector prior to entering the slots on the first connector to ensure that the connectors are attached in series. An advantage of using IDCs in the connectors is that the cable assembly can be produced without having to strip the insulative jackets off the individual wires.

Figure 10:
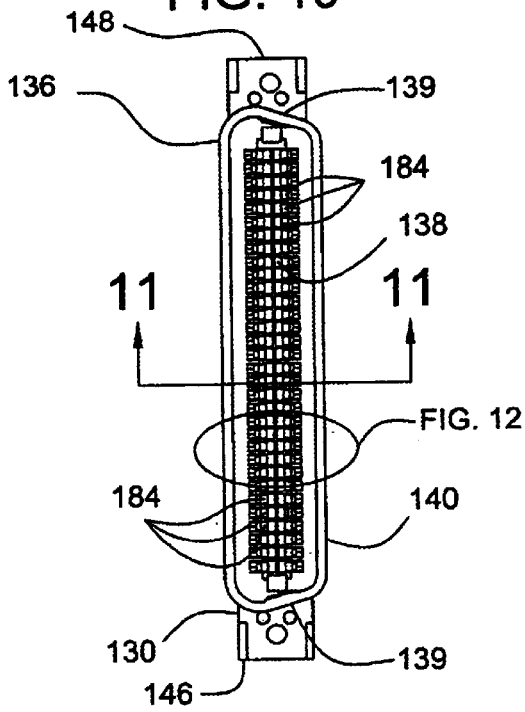
FIG. 10 is a front elevational view of the mating side of the first connector.

Referring to FIG. 4, for connecting with the electrical equipment and accommodating the terminal segments of the IDCs, each connector 110, 112 has a mating side 136, 156 defined by the housing 130, 150 located opposite the receiving sides 131, 151. Referring to FIGS. 10 and 11, the mating side 136 of the first housing 130 includes an outward extending tongue 138 surrounded by an elongated, trapezoidal shaped, thin-walled enclosure 140 and thereby defines a male connector. Disposed through the enclosure 140 at the top and bottom ends of the trapezoid are apertures 139. Referring to FIGS. 4 and 10, located between and extending beyond slot rows 134 and the mating side 136 are a first and second flange 146, 148.

Figure 12:
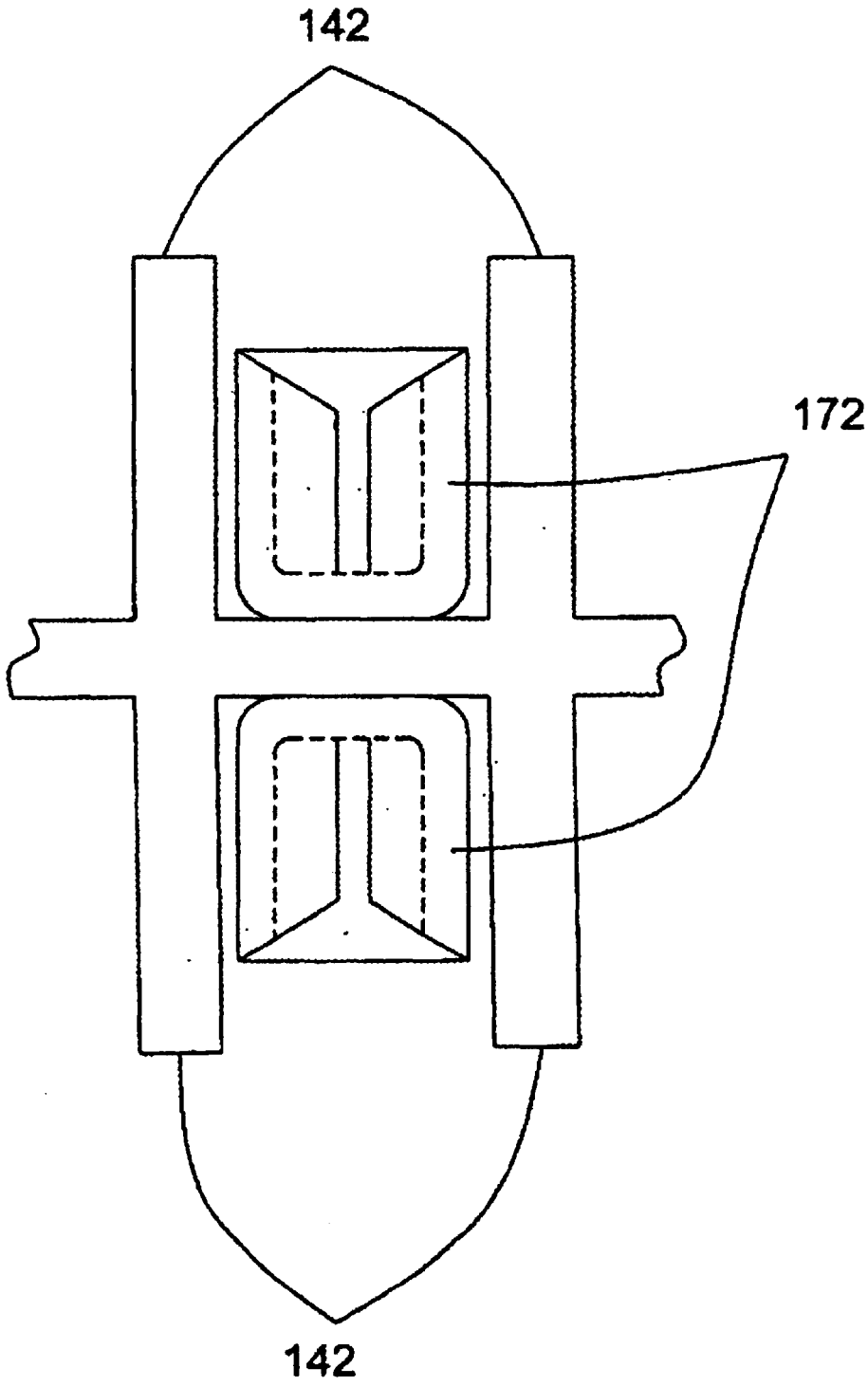
FIG. 12 is a detailed front elevational view of the indicated section of FIG. 10 illustrating the IDC's within the rows of slots.

To maximize the number of IDC's the connector can accommodate, as illustrated in FIG. 11, a second row of slots 144 is provided within the housing opposite the first row 134. Each slot in the first and second rows 134, 144 can accommodate the retaining segment 172 of one IDC 170 thereby providing for two opposing rows of IDC's within the housing 130. As illustrated in FIGS. 11 and 12, each slot in the opposing rows 134, 144 is defined by walls 142 that extend beyond the retaining segments 172 and that function to isolate the retaining segments from each other. In the illustrated embodiment, the total number of slots and thus of IDC's is 64, one for each wire of the cable. However, in other embodiments, the total number of slots and IDC's may differ, such as 50, 36, or 24 slots. In these embodiments, the IDC 170 is of a universal design which can be used in the male connector or the female connector.

Referring to FIG. 11, the spines 178 of the IDCs extend from the slots through the housing 130 and along the tongue 138. Thus, as illustrated in FIG. 10, because of the two rows of IDC's, the terminal segments 184 are likewise arranged in rows about the tongue 138. Referring to FIG. 11, the spine 178 of the IDC extends along and hooks around the exterior of the tongue 138 so as to be exposed towards the thin-walled enclosure 140. The upwards bend 186 of the terminal segment 184 causes the terminal segment to project slightly towards the enclosure 140.

Figure 14:
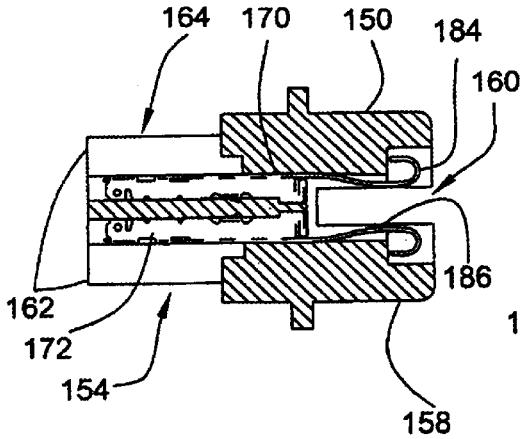
FIG. 14 is a cross sectional view of the second connector taken along line 14—14 of FIG. 13.

Referring to FIGS. 13 and 14, the mating side 156 of the second housing 150 is configured to define a female connector. The mating side 156 includes an outward extending receptacle 158 that defines and is divided by a gap 160. As illustrated in FIG. 14, the terminal portions 184 of the IDCs 170 extend along and are aligned about the inner surfaces of the receptacle 158 created by the gap 160 to form opposing rows. As illustrated in FIG. 14, because of the upward bend 186 formed into the terminal segment 184, the terminal segment protrudes slightly into the gap 160. Referring to FIG. 13, the exterior surface of the receptacle 158 is shaped to form an elongated trapezoid that is complementary with and can be received in the trapezoidal enclosure on the male first connector. Located at the ends of the receptacle 158 proximate to the gap are spring latches 159.

Like the first housing, as illustrated in FIG. 14, the second housing 150 also includes a second row 164 of slots opposite the first row 154 for accommodating the second row of IDCs 170. Preferably, a slot is provided for each wire in the cable. For the illustrated embodiment, the total number of slots between the first 154 and second rows 164 is 64. In other embodiments, the total number of slots may differ, such as 50, 36, or 24. Each slot is defined by walls 162 that extend beyond the retaining segments 172 and that function to isolate the retaining segments of the IDCs 170 from each other. Referring to FIGS. 4 and 13, the second housing 150 also includes third and fourth outward extending flanges 166, 168 that are positioned between the row of slots 154 and the mating face 156.

By way of example, the male and female connectors of the above-described type are available from Cinch Connectors, Inc. of Lombard, Ill., under part number 224 11 64 000 for the male connector and part number 224 12 64 000 for the female connector.

Referring to FIG. 1, the communications ports 103, 105, 107 of the network equipment 102, 104, 106 can be configured as corresponding male and female connectors. Referring to FIGS. 11 and 14, as will be appreciated by those of skill in the art, when the tongue 138 of the male first connector is inserted into a receptacle 158 on the equipment, the terminal segments 184 protruding from the tongue can engage the terminal segments 184 protruding into the gap 160. Similar engagement between terminal segments 184 occurs when the receptacle 158 of the female second connector is connected to a tongue 138 on the equipment. The trapezoidal shapes of the enclosure 140 and the receptacle 158 function to align the rows of terminal segments 184 on the tongue 138 with the terminal segments 184 in the receptacle 158. To releasably retain the connectors and equipment together, the spring latches 159 on the receptacle engage the apertures 139 disposed through the enclosure 140 in a manner commonly known by those of skill in the art.

While the first connector of the communications cable assembly has been described as a male connector and the second connector described as a female connector, it will be appreciated that exact style of the connectors are readily interchangeable depending upon the intended application. Thus, the second connector may be male and the first connector may be female, both connectors may be male, or both connectors may be female. Furthermore, referring to FIG. 1, the third connector 114 located at the opposite end of the communications cable assembly 100 may be either male, female, or some completely different type of connector.

Referring to FIG. 1, the overall length of the cable assembly 100 from the first connector 110 to the third connector 114 can be any suitable length as dependent upon the intended application. For example, the length of the cable assembly between the first and third connectors 110, 114 can be between ½ ft. and 100 ft.

Figure 15:
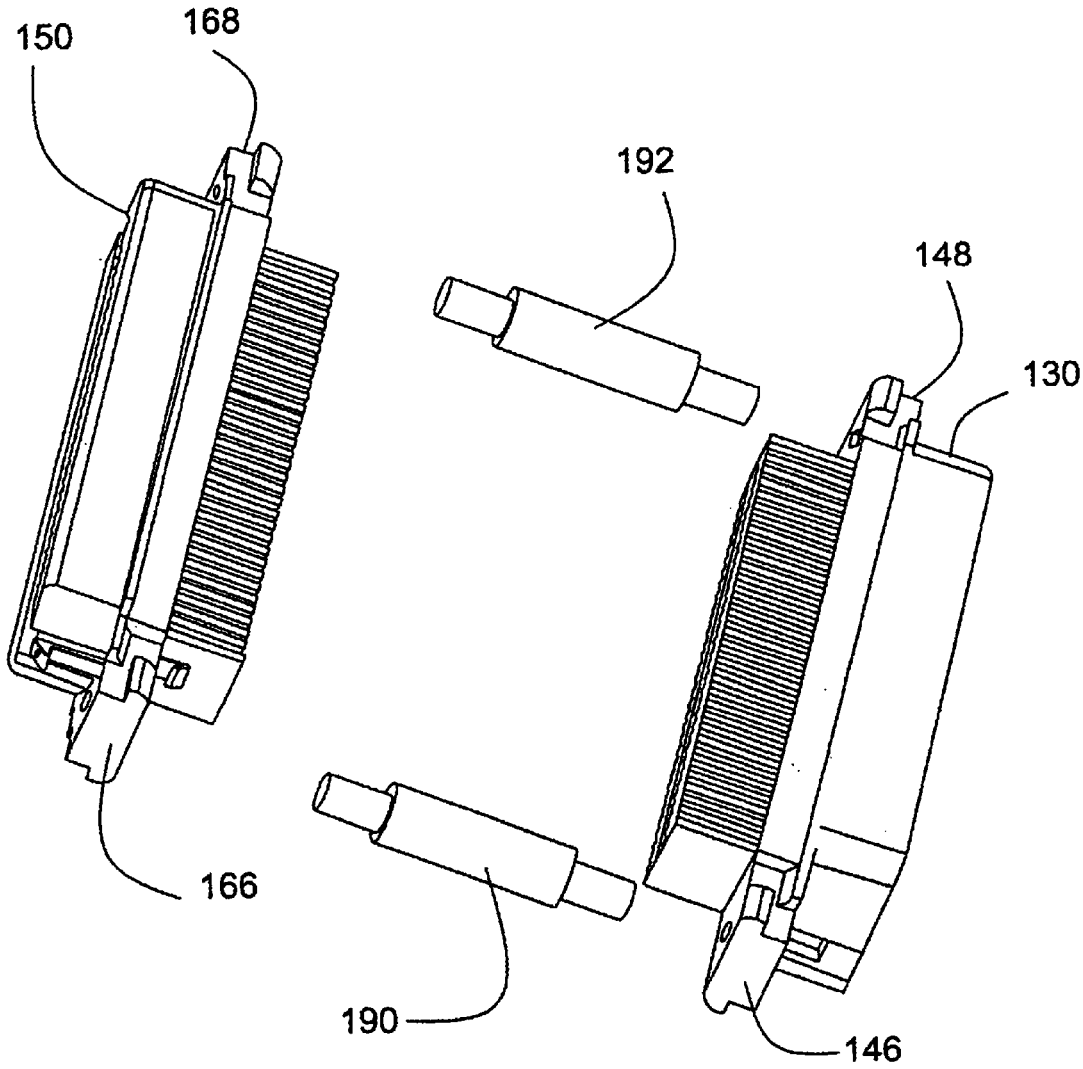
FIG. 15 is an exploded view illustrating the first and second connectors being bound together by cylindrical bushings.
Figure 16:
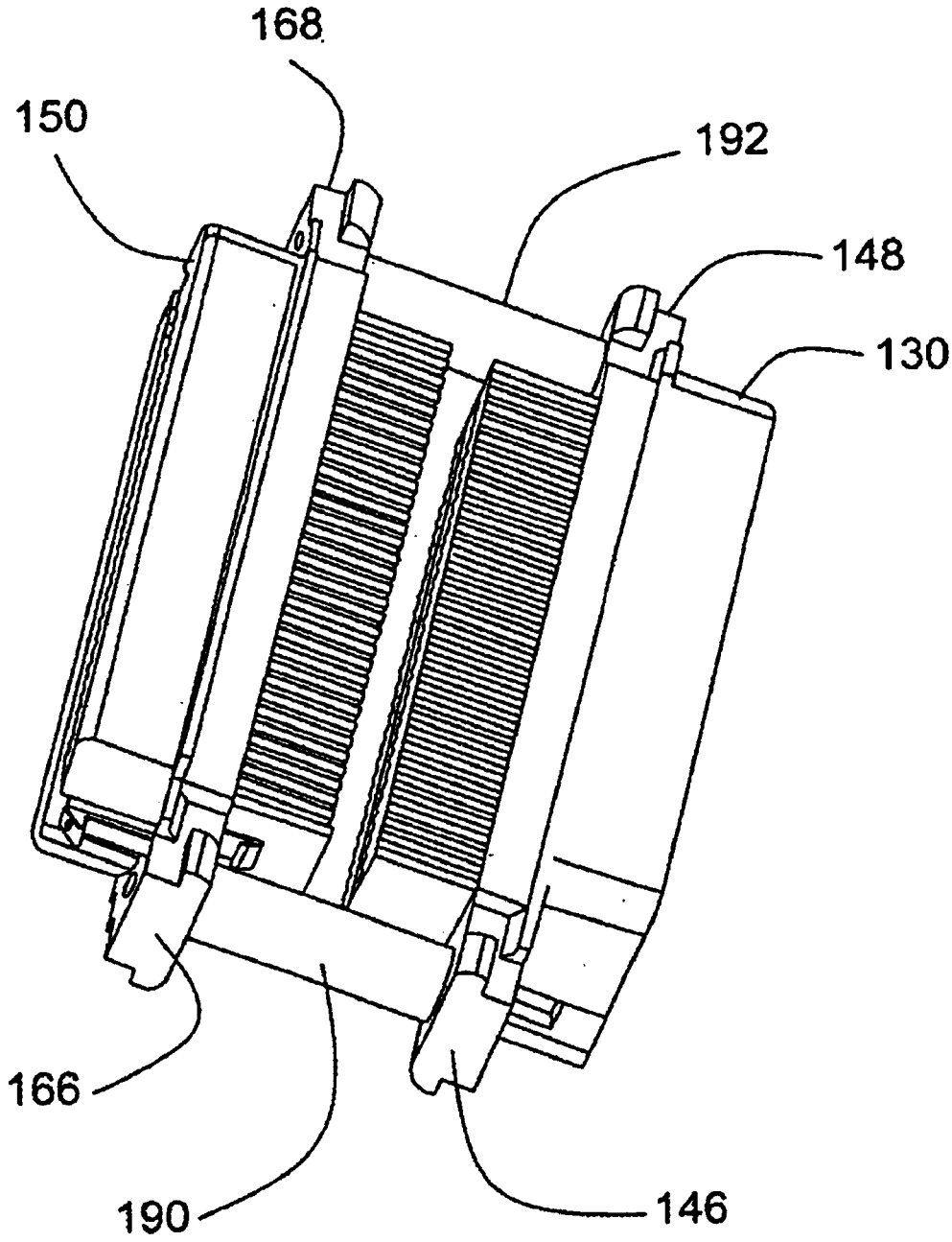
FIG. 16 is a perspective assembly view of the first and second connectors as bound together by cylindrical bushings.

In the embodiment illustrated in FIGS. 1 and 4, the first and second connectors are arranged in close proximity to each other in a back-to-back relationship. In the back-to-back arrangement, to prevent the wire lengths from being pulled loose from the IDCs and to align the slots of the first connector 110 with the slots of the second connector 112, the first and second housings 130, 150 can be rigidly bound together with the first receiving side 131 opposing the second receiving side 151. For example, in the embodiment illustrated in FIGS. 15 and 16, the rigid binding between the first and second housings 130, 150 is accomplished by a pair of cylindrical bushings 190, 192. Specifically, the first bushing 190 is secured to the first flange 146 and to the third flange 166 while the second bushing 192 is secured to the second flange 148 and to the fourth flange 168. Because the bushings extend between the flanges, the bushings do not obstruct the space between the first and second housings 130, 150 through which the wires must pass. Rivets, nuts, or threads can be used for securing the bushings to the flanges. Additionally, the bushings 190, 192 can be press fitted into holes disposed through the flanges.

Figure 17:
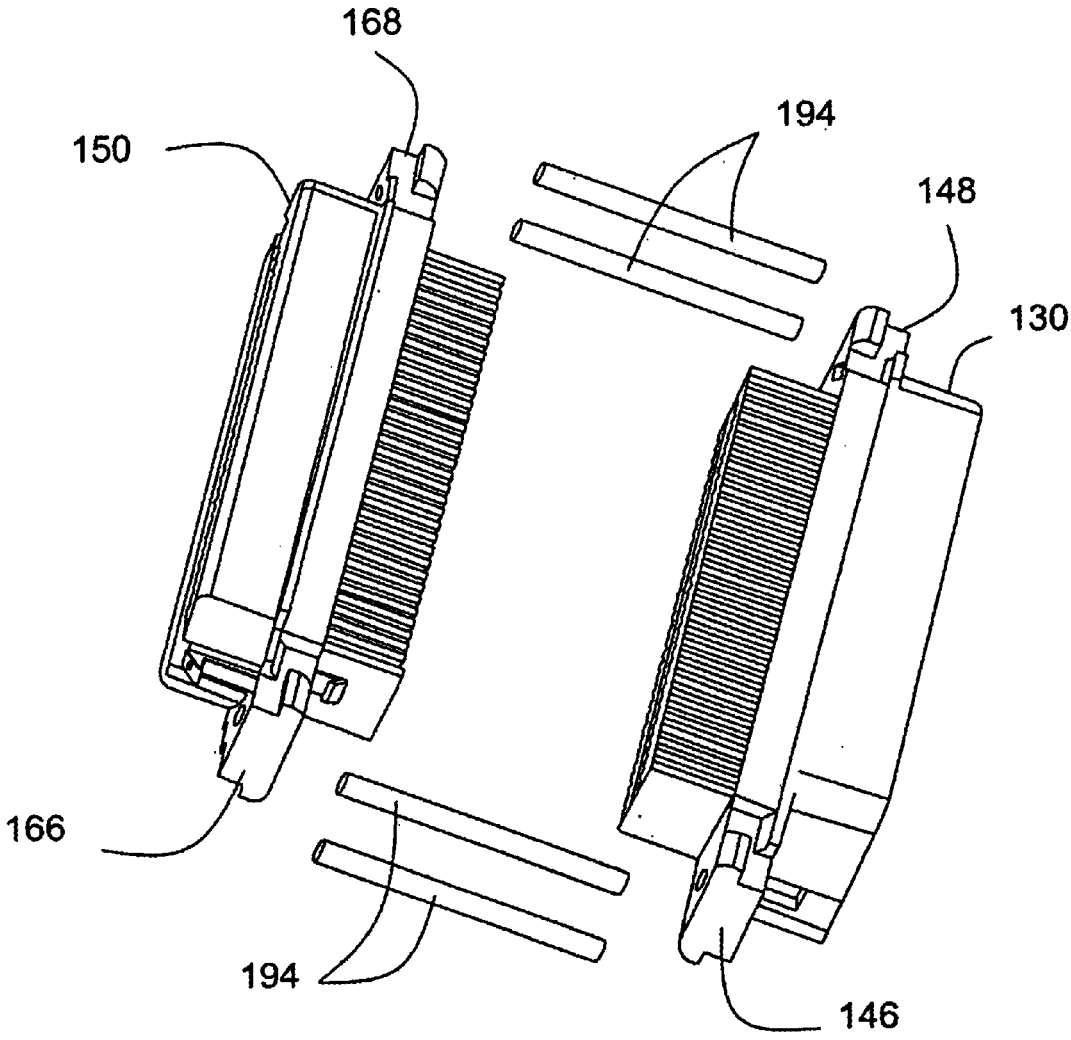
FIG. 17 is an exploded view illustrating the first and second connectors being bound together by roll pins.
Figure 18:
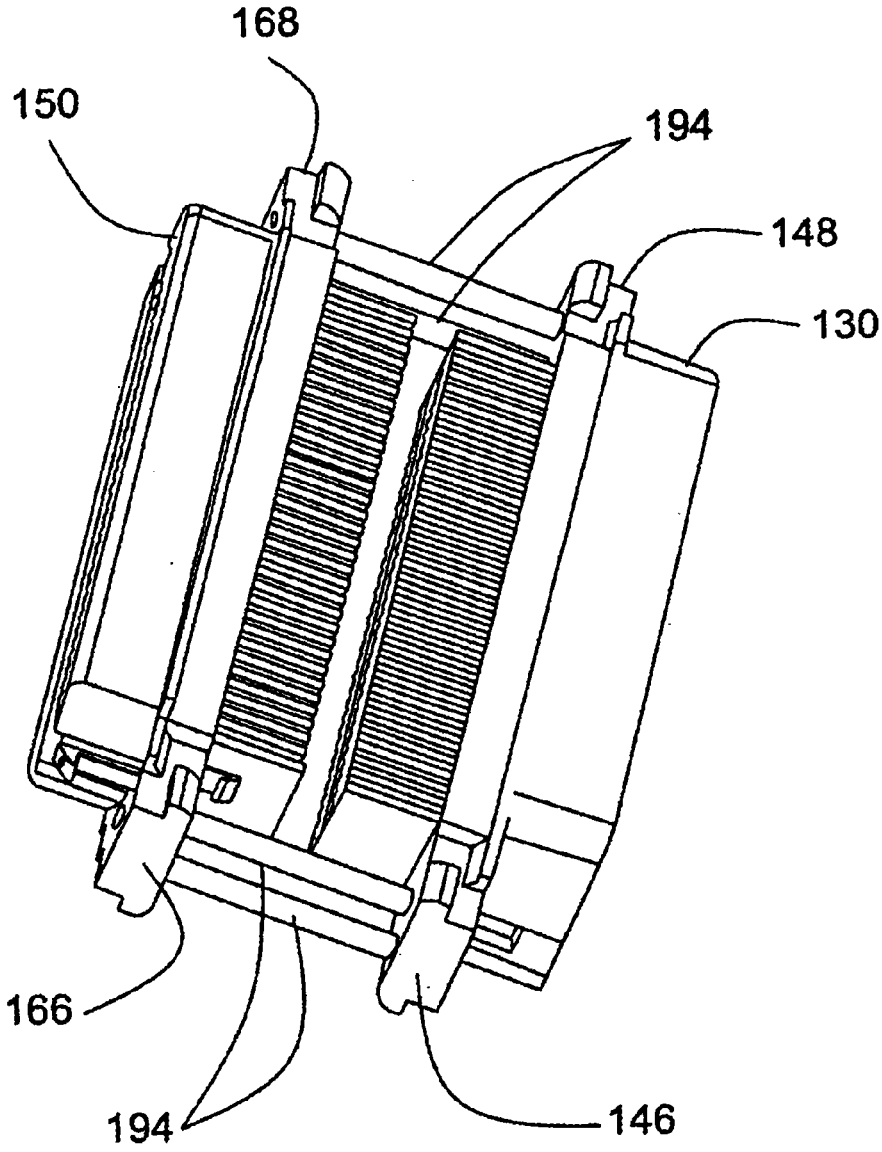
FIG. 18 is a perspective assembly view of the first and second connectors as bound together by roll pins.

In the embodiment illustrated in FIGS. 17 and 18, the rigid binding between the first and second housings 130, 150 can be accomplished by a plurality of roll pins 194. The roll pins 194 likewise extend between the first and second flanges of the first housing 130 and the third and fourth flanges 166, 168 of the second housing 150. The roll pins 194 can be secured to the flanges by, for instance, press fitting.

Figure 19:
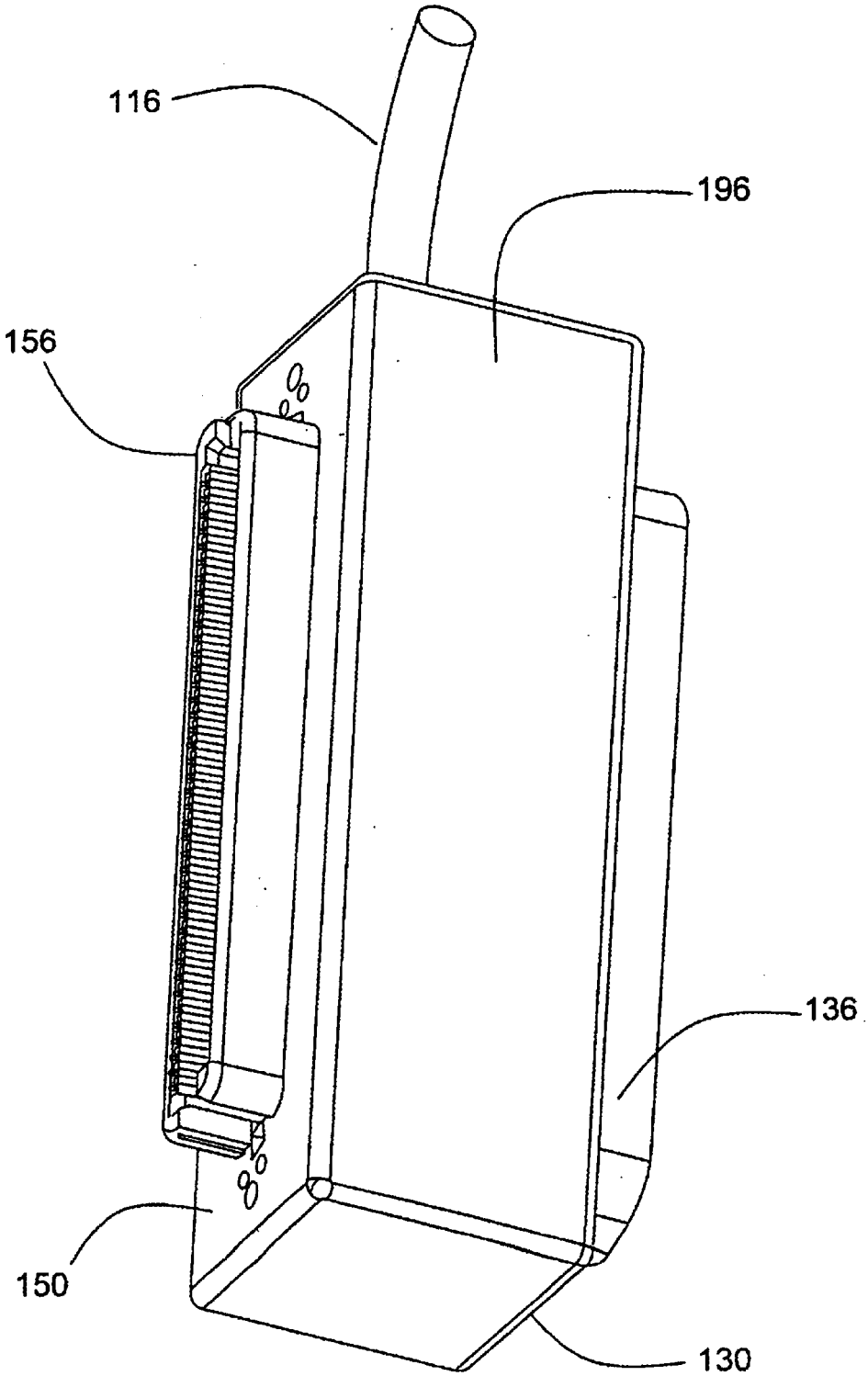
FIG. 19 is a perspective view of an embodiment in which the first and second connectors are molded together.
Figure 20:
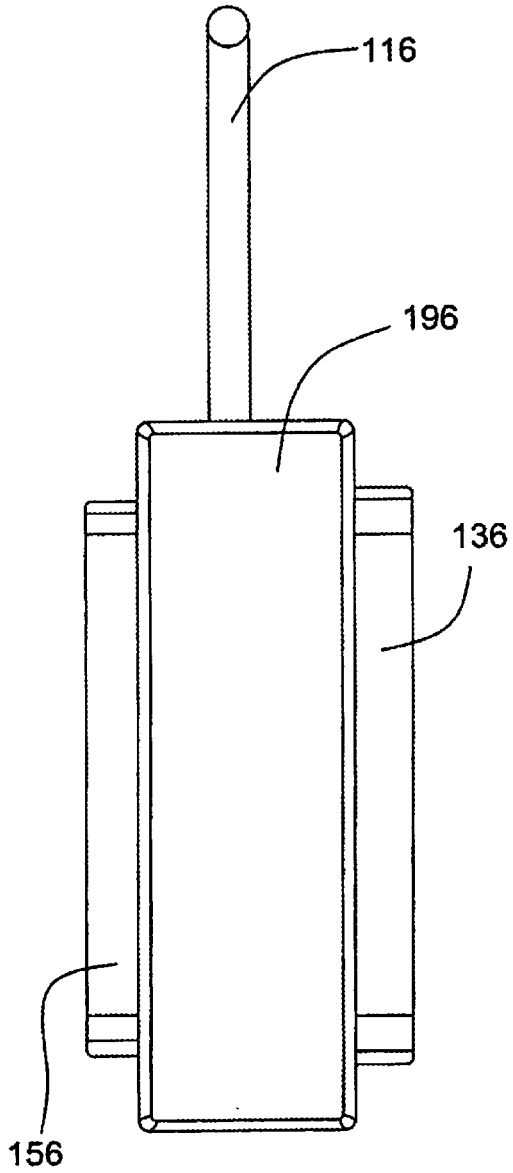
FIG. 20 is a top plan view of the embodiment of FIG. 19.
Figure 21:
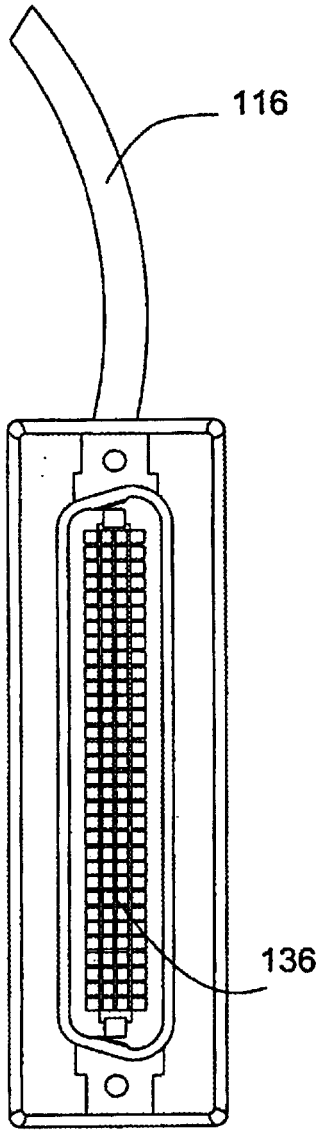
FIG. 21 is a front elevational view of the embodiment of FIG. 19 illustrating the mating side of the first connector.

In the embodiment illustrated in FIGS. 19, 20, and 21, the rigid binding is accomplished by molding the first housing 130 and the second housing 150 together. The mating side 136 the first housing 130 and mating side 156 of the second housing 150 are exposed on and extend from opposite sides of the molding. The slots of the two housings and the wire lengths extending there between are thereby enclosed within a molded wall 196 that is directly accessed by the cable 116. In an embodiment, the first and second housings 130, 150 may be rigidly bound together by roll pins or bushings as disclosed above prior to forming the molded wall 196. One advantage of an enclosed molding is that it protects the wires extending between the housings from exposure helping to prevent electrical shorting of the wires by a foreign object. Additionally, by rigidly binding the first and second housings 130, 150 together and enclosing the wires, the molded wall prevents the wires from inadvertently being pulled from the IDC's.

Figure 22:
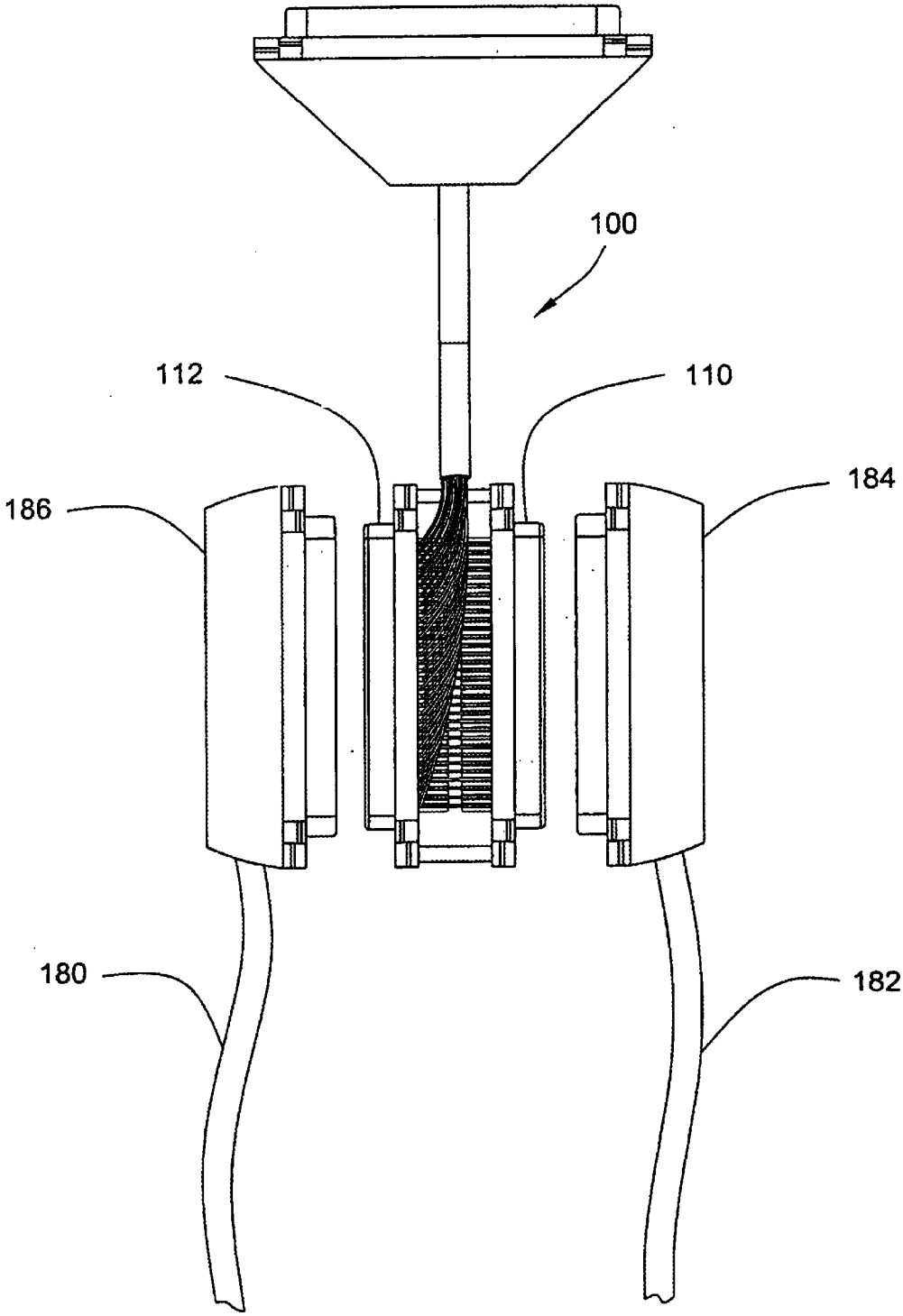
FIG. 22 is a top plan view of the communications cable assembly having features in accordance with the present invention situated for connection with additional cable assemblies.

In some potential applications, the electronic and/or testing equipment to be connected might not be in such close proximity so as to enable the use of the back-to-back style connector. Referring to FIG. 22, to configure the communications cable assembly 100 for use in such applications, extension cables 180, 182 can be connected to the cable assembly. The extension cables include a cable with either a male 184 or female 186 connector attached to the end that is complementary to the male and/or female housings of the first and second connectors 110, 112. The extension cables 180, 182 can then be connected to the remotely located equipment.

Figure 23:
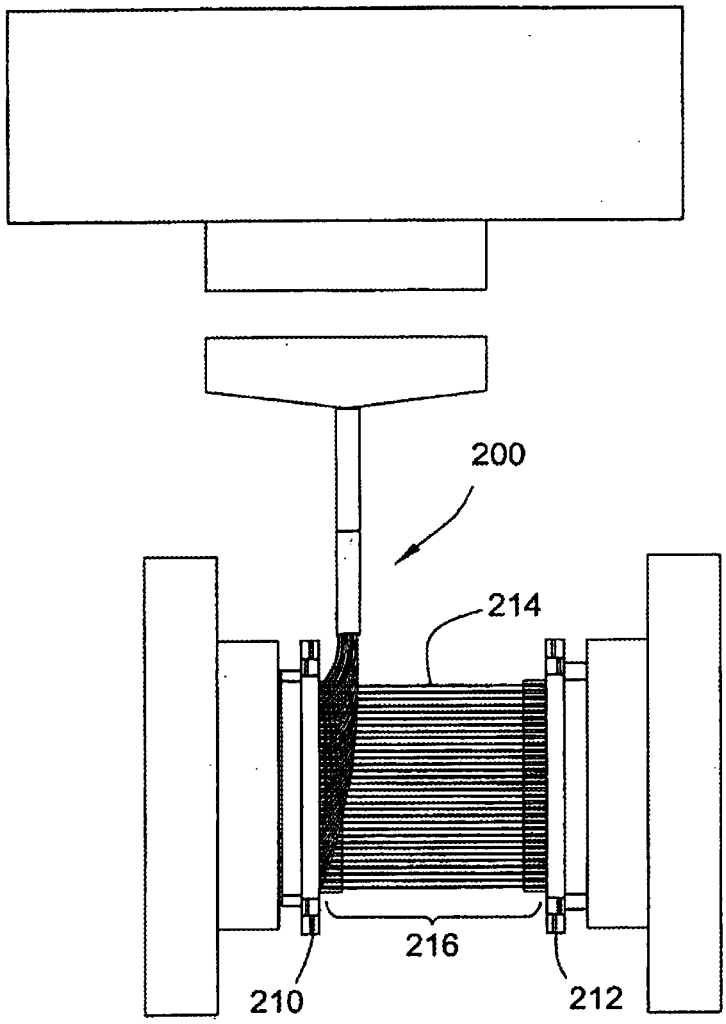
FIG. 23 is a top plan view of an embodiment of a communications cable assembly having features in accordance with the present invention situated in an exemplary network setting.
Figure 24:
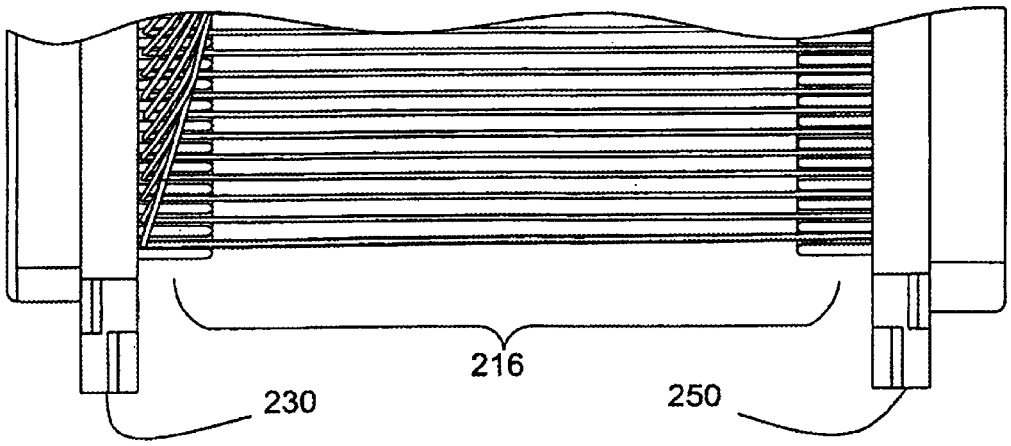
FIG. 24 is a detailed view of the communications cable assembly of FIG. 23 illustrating the first connector, second connector, and wires.

To connect the communications cable assembly 200 to remotely located equipment without the use of extension cables, as illustrated in FIG. 23, the first and second connectors 210, 212 can be placed at a substantial distance from each other. Accordingly, as illustrated in FIGS. 23 and 24, the wire portions 214 extending between the plurality of slots 220 on the second connector 210 and the plurality of slots 222 on the first connector 210 must be of a corresponding length. For example, the length 216 that the wire portions must extend can be between ½ ft. and 100 ft in length.

Figure 25:
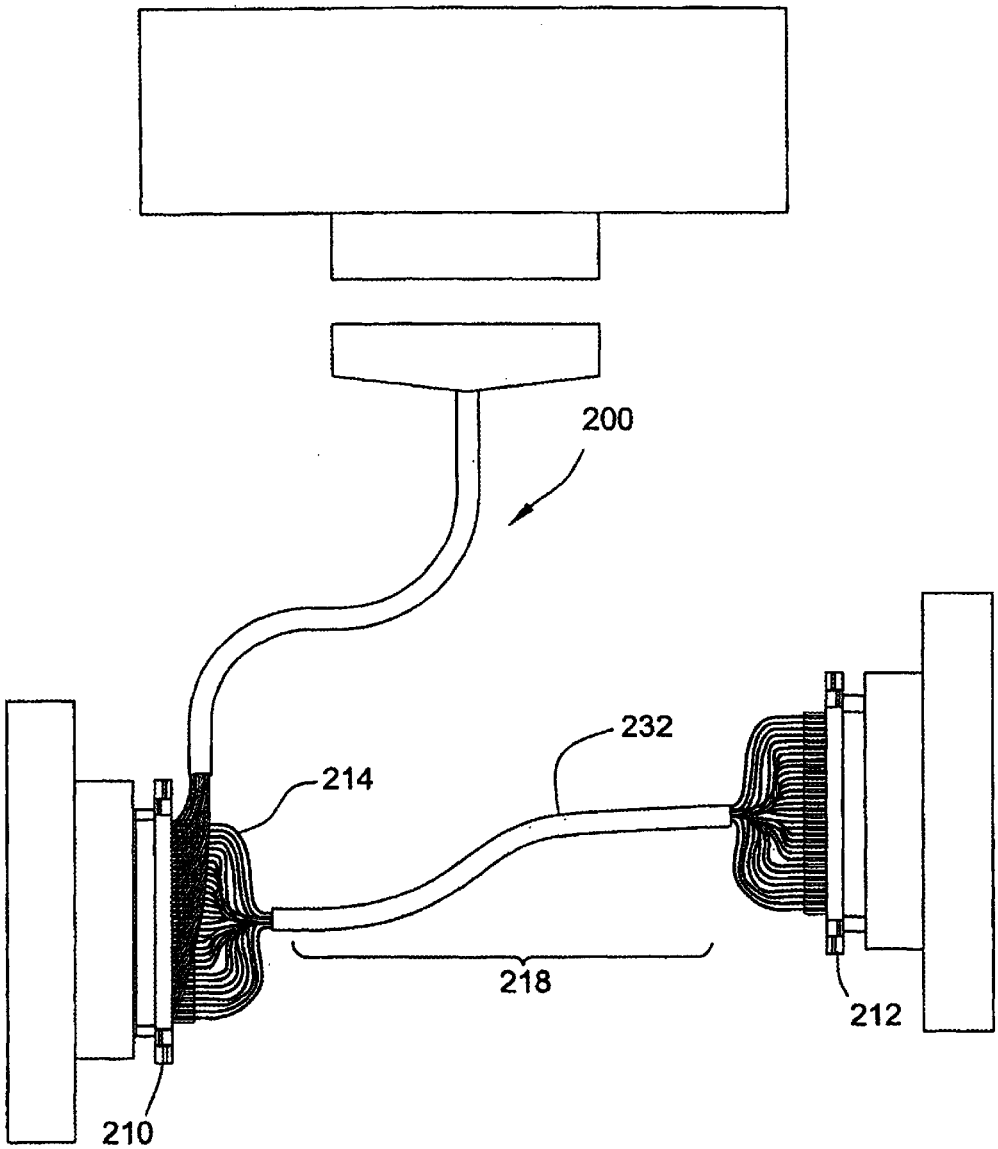
FIG. 25 is a top plan view of an embodiment of a communications cable assembly similar to the communications cable assembly illustrated in FIG. 23 with a cover over the extended wire portions.

When such lengths are used, it is no longer practical to rigidly bind the first and second housings 230, 250 together. Instead, the housings 230, 250 are only connected by the wire portions 214 which, because of the inherent flexibility of the wires, allows for the housings to be moved and adjusted with respect to one another. Maintaining flexibility between the first and second connectors simplifies routing the communications cable assembly between the equipment. In an embodiment illustrated in FIG. 25, to keep the wire portions 214 extending between the first and second connectors 210, 212 organized, the cover 232 of the cable can remain over the extended wire portions 214 and only that section of cover corresponding to where the wires are inserted into the slots of the first and second housings need be removed. The length 218 of the covered wire portions 214 extending between the connectors 210, 212 can be any given length, for instance, between ½ ft. and 100 ft.

As such, a communications cable assembly is provided having a length of cable with connectors at either end and an additional connector located in between, all connectors being connected to the cable in series. To simply connection of the wires from the cable to the connectors, the connectors house a plurality of IDC's in which the wires can be inserted without first having to strip off the insulative jackets. To enable connection and disconnection of different pieces of electronic and testing equipment, the connectors are formed with releasable male and female style housings.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments would become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. The communications cable assembly comprising:

a cable having a first end and a second end, the cable including a plurality of wires, each wire including an insulative jacket surrounding a core;

a first connector including a first housing and a first plurality of insulation displacement contacts, the first connector located proximate to the first end of the cable wherein at least one wire is inserted into an insulation displacement contact;

a second connector including a second housing and a second plurality of insulation displacement contacts, the second connector located between the first end and the second end of the cable, wherein the at least one wire is inserted into an insulation displacement contact of the second plurality, the second connector rigidly connected to the first connector by a bushing extending from the first housing to the second housing.

2. The communications cable assembly of claim 1, further comprising a second bushing extending from the first housing to the second housing.

3. The communications cable assembly of claim 1, wherein each housing includes a plurality of slots, each slot receiving one insulation displacement contact.

4. The communications cable assembly of claim 3, wherein the slots are aligned in a parallel relation.

5. The communications cable assembly of claim 3 wherein the third connector includes a third housing and a third plurality of insulation displacement contacts, the third connector located at the second end of the cable, wherein the at least one wire is inserted into an insulation displacement contact of the third plurality.

6. The communications cable assembly of claim 4, wherein the slots are divided into an upper row and an opposing lower row.

7. The communications cable assembly of claim 1, wherein the slots are oriented along a receiving side of each connector.

8. The communications cable assembly of claim 7 wherein the receiving side of the first connector is arranged opposing the receiving side of the second connector.

9. The communications cable assembly of claim 1, wherein the first connector is a male connector and the second connector is a female connector.

10. The communications cable assembly of claim 9, wherein cable assembly includes a third connector, the third connector is a male connector.

11. The communications cable assembly of claim 9, wherein cable assembly includes a third connector, the third connector is a female connector.

12. The communications cable assembly of claim 1, wherein the first connector is a female connector and the second connector is a male connector.

13. The communications cable assembly of claim 12, wherein cable assembly includes a third connector, the third connector is a male connector.

14. The communications cable assembly of claim 12, wherein cable assembly includes a third connector, the third connector is a female connector.

15. The communications cable assembly of claim 1, wherein the cable includes a cover generally surrounding the plurality of wires between approximately the second end and approximately the second connector.

16. The communications cable assembly of claim 1, wherein the length of cable between the first end and the second end is approximately in the range of 0.5 foot to 100 feet.

17. The communications cable assembly of claim 1 further comprising a third connector.

18. The communications cable assembly comprising:

a cable having a first end and a second end, the cable including a plurality of wires, each wire including an insulative jacket surrounding a core;

a first connector including a first housing, a first plurality of slots oriented along a receiving side of the first connector, and a first plurality of insulation displacement contacts, each slot receiving one insulation displacement contact, the first connector located proximate to the first end of the cable wherein at least one wire is inserted into an insulation displacement contact;

a second connector including a second housing, a second plurality of slots oriented along a receiving side of the second connector, and a second plurality of insulation displacement contacts, each slot receiving one insulation displacement contact, the second connector located between the first end and the second end of the cable, wherein the at least one wire is inserted into an insulation displacement contact of the second plurality, the second connector rigidly connected to the first connector by a pair of bushings such that the receiving side of the first connector opposes the receiving side of the second connector, a first bushing of the pair of bushings extends between a first flange perpendicular to the row of slots on the first housing and a third flange perpendicular to the row of slots on the second housing.

19. The communications cable assembly of claim 18, wherein the slots are aligned in a parallel relation.

20. The communications cable assembly of claim 19, wherein the slots are divided into an upper row and an opposing lower row.

21. The communications cable assembly of claim 18, wherein the first connector is a male connector and the second connector is a female connector.

22. The communications cable assembly of claim 21, wherein cable assembly includes a third connector, the third connector is a male connector.

23. The communications cable assembly of claim 21, wherein cable assembly includes a third connector, the third connector is a female connector.

24. The communications cable assembly of claim 18, wherein the first connector is a female connector and the second connector is a male connector.

25. The communications cable assembly of claim 24, wherein cable assembly includes a third connector, the third connector is a male connector.

26. The communications cable assembly of claim 24, wherein cable assembly includes a third connector, the third connector is a female connector.

27. The communications cable assembly of claim 18, wherein the cable includes a cover generally surrounding the plurality of wires between approximately the second end and approximately the second connector.

28. The communications cable assembly of claim 18, wherein the length of cable between the first end and the second end is approximately in the range of 0.5 foot to 100 feet.

29. The communications cable assembly of claim 18 further comprising a third connector.

30. The communications cable assembly of claim 29 wherein the third connector includes a third housing and a third plurality of insulation displacement contacts, the third connector located at the second end of the cable, wherein the at least one wire is inserted into an insulation displacement contact of the third plurality.

31. The communications cable assembly of claim 18, wherein a second bushing of the pair of bushings extends between a second flange perpendicular to the row of slots on the first housing and a fourth flange perpendicular to the row of slots on the second housing.

* * * * *